United States Patent [19]

Kimsey

[11] 4,376,344

[45] Mar. 15, 1983

[54] INSULATED BOOT BLANKET

[76] Inventor: Cheston B. Kimsey, P.O. Box 197, Clarkesville, Ga. 30523

[21] Appl. No.: 272,352

[22] Filed: Jun. 10, 1981

[51] Int. Cl.[3] ..... A43B 3/16

[52] U.S. Cl. ..... 36/7.1 R; 12/142 R; 36/7.2; 36/50

[58] Field of Search ..... 36/123, 7.1 R, 7.2, 36/7.4, 7.3, 50, 51, 9 R; 12/142 R, 142 G

[56] References Cited

U.S. PATENT DOCUMENTS

| | | | |
|---|---|---|---|
| 2,630,636 | 3/1953 | Cockrell | 36/9 R |
| 2,846,784 | 8/1958 | Bush | 36/51 |
| 3,280,485 | 10/1966 | Arnold | 36/7.3 |
| 3,358,188 | 12/1967 | Zimmon | 36/7.1 R |
| 3,422,550 | 1/1969 | Robinson | 36/7.1 R |

FOREIGN PATENT DOCUMENTS

| | | | |
|---|---|---|---|
| 2918338 | 11/1980 | Fed. Rep. of Germany | 36/7.3 |

*Primary Examiner*—Werner H. Schroeder
*Assistant Examiner*—Steven N. Meyers
*Attorney, Agent, or Firm*—L. Lawton Rogers, III

[57] ABSTRACT

An insulated boot blanket of a light weight moisture impervious insulated material adapted to be worn over the shoe or boot-enclosed foot. The boot blanket is provided with either one or three piece construction, is provided side straps which facilitate both the insertion of the shoe-enclosed foot into the boot blankets and the carrying of the boot blankets against the small of the back when not being worn, and a drawstring for selectively adjusting the leg opening and for maintaining the downwardly opening zipper in a closed position when the boot blanket is being worn. A flexible sole may also be provided for increased wear.

16 Claims, 10 Drawing Figures

INSULATED BOOT BLANKET

BACKGROUND OF THE INVENTION

The present invention relates to insulated boot blankets to increase the warmth of the wearer's feet while engaged in sedentary activities such as that of a hunter on a deer stand or a spectator at an outdoor sporting event such as a football game.

The cooling of the extremities and in particular the feet has long been recognized as a serious problem in sedentary activities in the outdoors and various proposals have been advanced for dealing with this problem. In one such approach, the boots are provided with removable insulative linings. Examples of such boots are illustrated in the Wilson U.S. Pat. No. 2,398,510 dated Apr. 16, 1946, the Woyach U.S. Pat. No. 2,440,563 dated Apr. 27, 1948, the Smith U.S. Pat. No. 2,439,493, dated Apr. 13, 1948, and the German Pat. No. 607,268 dated Dec. 20, 1934. Boots of this type with removable liners are generally front opening and basically provide for the removal of the inner insulative lining when the additional warmth is not required. Because such boots are generally provided with rigid feet or sole structures, carrying and storage problems generally exist.

Another approach such as that disclosed in the Jacobson U.S. Pat. No. 3,373,512 dated Mar. 19, 1968 and the Gibson U.S. Pat. No. 4,099,341 dated July 11, 1978 have utilized stiff insulating foam material such as polystyrene. Such boots may be worn over the shoe-encased foot and the transportation and storage thereof is generally a problem due to their rigidity.

Another approach to the problem is disclosed in the Saunders U.S. Pat. No. 2,984,917 dated May 23, 1961 and the Henderson U.S. Pat. No. 3,875,687 dated Apr. 8, 1975 in which insulative covers are provided to be worn externally of winter sport shoes such as ice skates and ski boots. Because of the specialized nature of such footwear, such insulative coverings, though generally flexible, do not provide an essentially airtight and watertight barrier to and are generally quite difficult to properly place in position.

It is accordingly an object of the present invention to provide a novel boot blanket which obviates many of the problems of the prior art and which may be easily carried to the place of use, easily used, and easily removed for the return home.

It is another object of the present invention to provide a novel method of construction and boot blanket which is flexible and light in weight while maintaining excellent insulative characteristics.

A further object of the present invention is to provide a novel method and boot blanket in which the means for selectively adjusting the size of the leg opening may be used to maintain the boot blanket in a closed position.

It is yet another object of the present invention to provide a novel method of construction and boot blanket which is rear opening and provided with handling means to facilitate the insertion of the shoe encased foot into the boot blanket.

Yet a further object of the present invention is to provide a novel method of construction and boot blanket including means for carrying the boot blanket when not in use adjacent the small of the back to free the hands and to provide additional warmth at that part of the anatomy.

These and many other objects and advantages will be readily apparent to one skilled in the art to which the invention pertains from a perusal of the claims and the following detailed description of preferred embodiments and read in conjunction with the appended drawings.

THE DRAWINGS

DETAILED DESCRIPTION OF PREFERRED EMBODIMENTS

Figure 1:
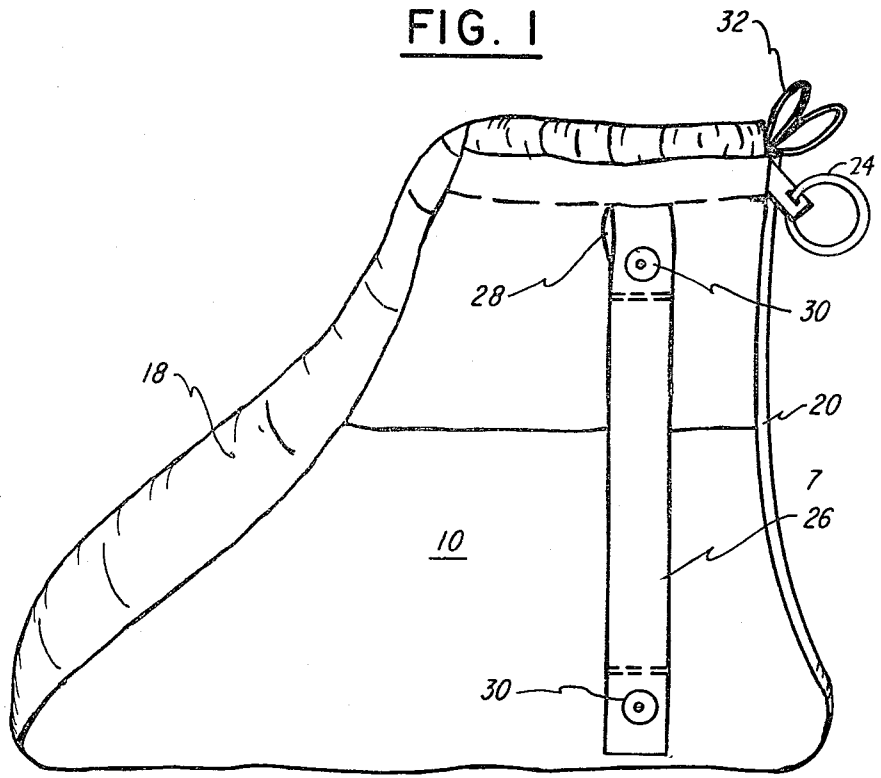
FIG. 1 is a left side view in elevation of one embodiment of the boot blanket of the present invention.

With reference to the figures where like elements have been given like numerical designation to facilitate an understanding of the present invention, and particularly with reference to the embodiment of the boot blanket of the present invention illustrated in FIGS. 1, 2, 3A and 4, the boot blanket may be constructed of a left-side panel 10, a right-side panel 12, and an elongated central panel 14 having a central portion 16, a front portion 18 and a rear portion 20.

Figure 2:
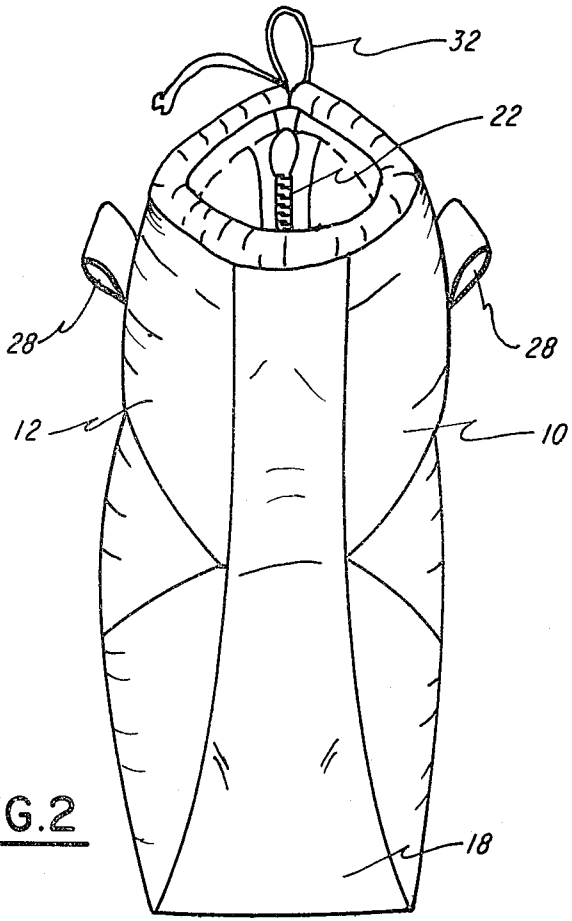
FIG. 2 is a pictorial front view of the boot blanket of FIG. 1.
Figure 3C:
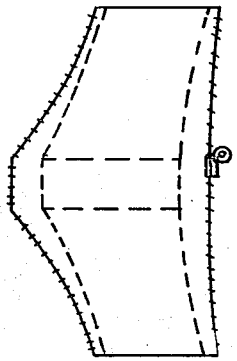
FIG. 3C is a further one-piece embodiment of the boot blanket of the present invention.
Figure 4:
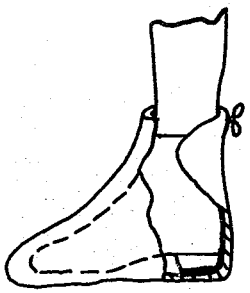
FIG. 4 is a pictorial view in elevation and in partial section illustrating the wearing of the boot blanket of the present invention over a shoe-enclosed foot.
Figure 3A:
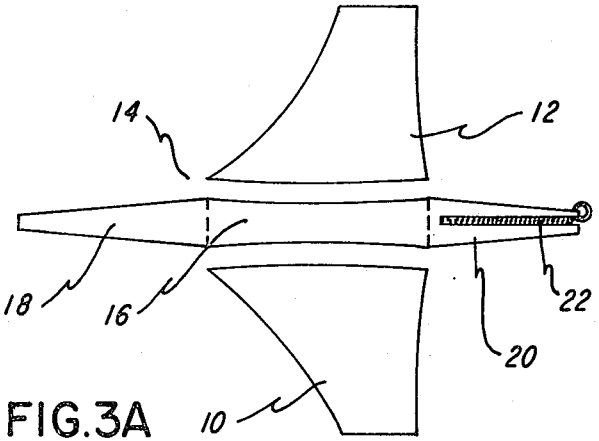
FIG. 3A is an exploded view of the three panels of the boot blanket of FIGS. 1 and 2.

As perhaps seen more clearly in FIGS. 2 and 3A, the front panel 18 may be tapered generally from a width which corresponds to the bottom panel 16 to a width at the free end thereof of approximately one-half the width of the bottom panel. Similarly, the rear panel 20 may be generally tapered from a width equal to the width of the bottom panel 16 to a width at the free end thereof of approximately one-half of that dimension. The taper of the front and rear panels 18, 20 need not be straight lines and they follow a general gentle curve to facilitate conformity of the assembled boot blanket to the human foot when encased in a shoe or boot as illustrated in FIG. 4.

The rear panel 20 may be provided with a heavy duty zipper 22 extending the length of the panel 20 an opening from the free end thereof toward the bottom panel 16. As shown in FIG. 1, the zipper is desirably provided with a closed pull such as the illustrated ring 24 to facilitate operation of the zipper without removal of gloves. As suggested in FIG. 1, the zipper pull may be a loop having a diameter sufficient to permit the passage therethrough of a gloved finger.

Figure 3B:
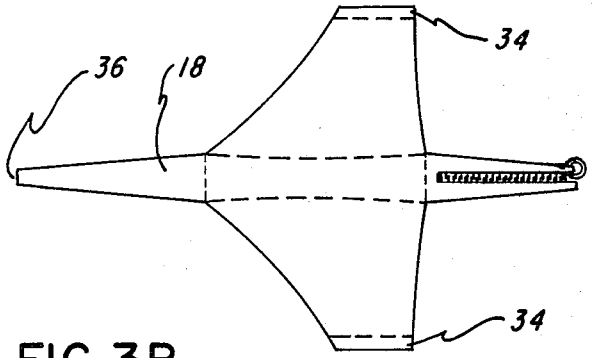
FIG. 3B is a one-piece embodiment of the boot blanket of the present invention.

The material for the two side panels 10, 12 and the central panel 14 may be of the same material and may in fact, as illustrated in FIG. 3B, be formed from a single piece of material. This material is desirably formed of a water resistant synthetic fiber such as nylon on at least the outer surface thereof and provided with suitable conventional insulating material such as goose down or synthetic fibers inwardly of the outer layer. A second layer of material such as nylon may be used on the inside of the material and the material quilted in conventional manner.

As shown in FIG. 3C, the back panel may be incorporated into the side panels and/or the front panel may also be provided with a zipper to facilitate use of the boot blanket, i.e. by placing the boot encased foot on the opened blanket and zipping the blanket closed from the front and from the back thereof.

With continued reference to FIGS. 1 and 2, both of side panels 10 and 12 may be provided with vertical straps 26 stitched or otherwise attached thereto. The upper end of both of the straps 26 is desirably provided with a closed loop 28 of sufficient diameter to permit the insertion therein of a gloved finger. The loops 28 are useful in facilitating the handling of the boot blanket in the insertion of the shoe or boot encased foot into the boot blanket in that the loops may be grasped and pulled rearwardly and upwardly over the shoe encased foot.

As shown in FIG. 1, the straps 10 may be provided with suitable conventional fasteners 30 which may be of the snap type as illustrated or the fibrous type known as grosgrain. As will be subsequently explained in connection with FIGS. 6 and 7, these fasteners are useful in carrying the boot blankets of the present invention.

With continued reference to FIGS. 1 and 2, the boot blankets of the present invention are desirably provided adjacent the leg opening with a suitable conventional drawstring 32. The leg opening is formed by the upper edges of the two side panels and the free ends of the front panel 18 and rear panel 20. The addition of the drawstring 32 facilitates the drawing of the leg opening snugly about the leg of the wearer when the boot blankets are in use. In addition, the drawstring may be passed through the zipper pull 24 to secure the zipper in the closed position when the boot blankets are in use. As shown in FIG. 3B, the loops for the drawstring 32 may easily be provided by the inward folding of the fabric and the stitching thereof along the top edges and the free end 36 of the front panel 18 prior to the stitching of the front panel to the side panels and the stitching of the rear panel to the rear edges of the side panels to form the completed boot blanket.

Figure 5:
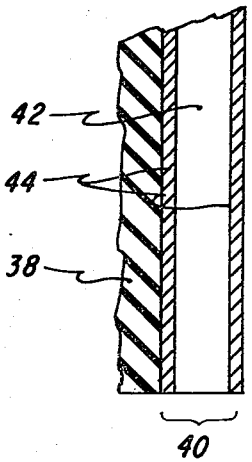
FIG. 5 is a longitudinal section of the sole of the present invention in elevation.
Figure 6:
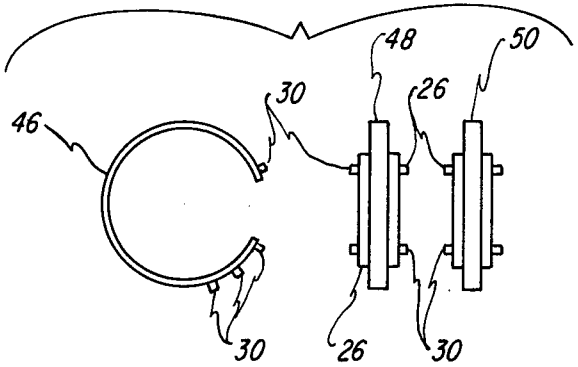
FIG. 6 is a top plan view of the boot blanket of the present invention with carrying belt.

The boot blanket illustrated in FIGS. 1 and 2 is not provided with a separate sole. It has been found that separate soles are not generally necessary in that prolonged walking is not anticipated while the boot blankets are being worn. However, as illustrated in FIG. 5, a separate sole 38 may be secured by an adhesive or other suitable conventional means to the fabric 40 of the boot blanket. As illustrated in FIG. 5, the fabric 40 may comprise a sandwich of insulating material 42 between opposite layers of nylon or other moisture impervious fabric 44. If provided, it is desirable that the sole 38 to the boot blanket be flexible so as not to impede the flexible handling of the boot blanket. As shown more clearly in FIGS. 6 and 7, it has been found convenient to carry the boot blanket of the present invention by means of a belt 46 provided with means adjacent the ends thereof for mating with the fasteners 30 on the straps 26 of the boot blankets. As illustrated in FIG. 6, the belt 46 may be made adjustable in length by means of a provision of a plurality of spaced fasteners. Any other suitable conventional means of adjusting the length of the belt 46 may be utilized.

Figure 7:
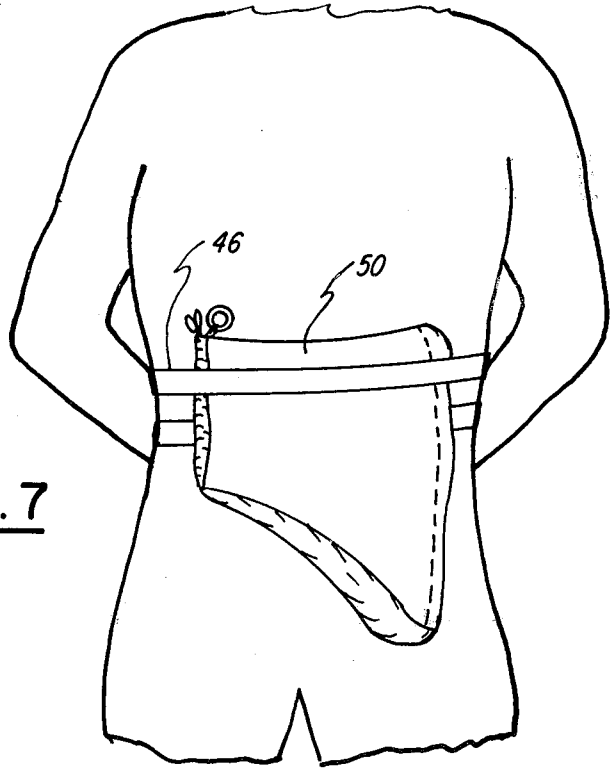
FIG. 7 is a pictorial view in elevation illustrating a preferred method of carrying the boot blanket of the present invention.
Figure 8:
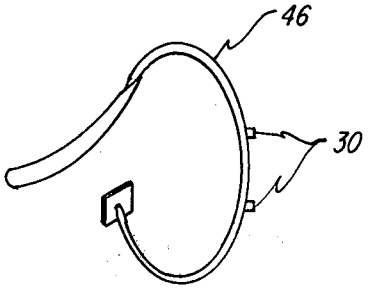
FIG. 8 is a pictorial view of a second belt for carrying the present invention.

With continued reference to FIGS. 6 and 7, the two boot blankets 48 and 50 may be fastened together by means of the fasteners 30 and the innermost one of 48 of the two boot blankets attached by means of the fasteners 30 to the belt with the belt worn around the human waist. Alternatively, as illustrated in FIG. 7, the strap 46 may be worn on the outside of the outermost one 50 of the two boot blankets generally at waist level or slightly above as illustrated in FIG. 7. As shown in FIG. 8, the belt 48 may be provided with fastener 30 and adjusted by means of any suitable conventional buckle or other fastener.

The soft and flexible nature of the boot blankets of the present invention, even when provided with a flexible sole, greatly facilitates the carrying of the boot blankets around the human waist against the small of the back. In this position, the boot blankets are not only out of the way of arm movement along the side of the body, but the insulation of the boot blankets provides for increased warmth at that sensitive portion of the human body.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. A mating pair of insulated boot blankets each comprising:

a right side panel of a quilted and thermally insulative material having a moisture impervious outer layer and conforming generally to the shape of a shoe or boot-encased human foot to provide a front, top, lower and rear edge;

a left side panel of a quilted and thermally insulative material having a moisture impervious outer layer conforming generally to the shape of a shoe or boot-encased human foot to provide a front, top, lower and rear edge;

a longitudinal panel of a quilted and thermally insulative material having a central portion of substantially constant width secured to the lower edges of both of said side panels over the length thereof to thereby form a bottom panel;

said longitudinal panel having a front portion tapering generally from the width of said bottom panel to a width of approximately one-half the width of said bottom panel at the free end thereof, said front portion being secured to the front edge of both of said side panels over the length thereof to thereby form a front panel, said longitudinal panel having a rear portion tapering generally from the width of said bottom panel to a width approximately one-half of the width of said bottom panel, said rear portion being secured to the rear edges of both of said side panels over the length thereof to thereby form a rear panel;

a zipper disposed longitudinally of said rear panel along the center thereof and opening downwardly from the free end of said rear panel toward said bottom panel over substantially the entire length of said bottom panel to thereby form a means of inserting a shoe or boot-encased human foot into the boot blanket from the rear thereof;

a drawstring disposed adjacent the free end of said front and rear panels and the top edges of said side panels for drawing the opening formed thereby snugly around the leg above the top of the shoe or boot-encased foot and for maintaining the opening so drawn by tying at the rear of the boot blanket;

a belt having a selective adjustable length adapted to fit around the waist of a human body and having a fastener adjacent both ends thereof;

a pair of generally vertical straps carried by said side panels on the outer surface thereof, said straps being provided with closed loops at the upper extremities thereof to facilitate the insertion of a finger of the human hand for putting the boot blanket rearwardly and upwardly over the shoe or boot encased foot, said straps being provided with fasteners for removably gripping either the fasteners of a strap of the mating boot blanket as well as the fastener of said belt whereby the mating pair of boot blankets may be selectively and removably attached to each other and to said belt to be carried adjacent to the small of the human back when not being worn as boot blankets.

2. The boot blankets of claim 1 including a flexible sole carried by said bottom panel to reduce the wear on said bottom panel when the boot blankets are worn while walking.

3. The boot blanket of claim 2 wherein the zipper is provided with a closed pull sufficiently large for the insertion of a gloved finger therein in operating the zipper, said drawstring being adapted to pass through said closed pull to secure said zipper in a closed position when the opening in the boot blanket has been drawn snugly about the leg of the wearer.

4. A boot blanket comprising a pair of side panels with top, bottom, front and rear edges, and a longitudinal panel having a central portion secured to the bottom edges of said side panels to form a bottom panel, having a front portion secured to the front edges of said side panels to form a front panel, and having a rear portion secured to the rear edges of said side panels to form a rear panel, the top edges of said side panels and the free ends of said front and rear panels forming an opening for the leg of the wearer, said back panel having a zipper extending over the length thereof and opening downwardly from said leg opening to said bottom panel.

5. The boot blanket of claim 4 including means for selectively adjusting the size of said leg opening.

6. The boot blanket of claim 5 wherein said leg opening size adjusting means includes means for retaining said zipper in a closed position.

7. The boot blanket of claim 6 including means for carrying the boot blanket in the small of a human back when not being worn.

8. The boot blanket of claim 7 including a flexible sole carried by said bottom panel to reduce the wear thereof through use.

9. The boot blanket of claim 4 including strap means carried by said side panels adapted for gripping by the human hand for inserting a shoe or boot-enclosed foot therein and adapted for securing one boot blanket to another when not being worn.

10. The boot blanket of claim 9 including means for selectively adjusting the size of the leg opening and for maintaining said zipper in a closed position.

11. The boot blanket of claim 10 wherein said bottom panel includes a flexible outer side for reducing the wear thereof when worn.

12. The boot blanket of claim 4 wherein said bottom panel includes a flexible outer side for reducing the wear thereof when worn.

13. The boot blanket of claim 4 including a zipper extending the length of said front panel and opening downwardly from said leg opening toward said bottom panel.

14. The boot blanket of claim 4 wherein said front and rear panels are integral with side panels.

15. A method of making a boot blanket comprising the steps of:

(a) providing a pair of matching side panels and an elongated central panel;

(b) securing the lower edge of the side panels to opposite lateral sides of the central panel to form a bottom panel;

(c) securing opposite lateral sides of one end of the central panel to the front edges of the two side panels to form a front panel; and (d) securing opposite lateral sides of the other end of the central panel to the rear edges of the two side panels to form a rear panel, so that the free ends of the front and rear panels and the top edges of the two side panels form a leg opening.

16. The method of claim 15 including the further step of attaching a flexible sole to the bottom panel.

* * * * *